United States Patent [19]

Kish et al.

[11] Patent Number: 4,528,420

[45] Date of Patent: Jul. 9, 1985

[54] COLOR CODING IDENTIFICATION OF CONDUCTORS IN TELECOMMUNICATIONS CABLE

[75] Inventors: Paul P. Kish, Dorval; Giovanni J. Discenza, Ville Ste. Catherine, both of Canada

[73] Assignee: Northern Telecom Limited, Montreal, Canada

[21] Appl. No.: 483,222

[22] Filed: Apr. 8, 1983

[51] Int. Cl.[3] ..... H01B 7/36

[52] U.S. Cl. ..... 174/112

[58] Field of Search ..... 174/112

[56] References Cited

U.S. PATENT DOCUMENTS

| | | | |
|---|---|---|---|
| 3,020,335 | 2/1962 | Gillis | 174/112 |
| 3,031,524 | 4/1962 | Hicks | 174/112 |
| 3,994,090 | 11/1976 | Wheeler | 174/112 X |
| 4,128,736 | 5/1978 | Nutt et al. | 174/112 |
| 4,158,746 | 6/1979 | Taylor et al. | 174/112 |

FOREIGN PATENT DOCUMENTS

| | | | |
|---|---|---|---|
| 1086635 | 10/1967 | United Kingdom | 174/112 |

*Primary Examiner*—A. T. Grimley
*Assistant Examiner*—Morris H. Nimmo
*Attorney, Agent, or Firm*—R. J. Austin

[57] ABSTRACT

A binder unit of twenty-five twisted pairs of pulp or paper insulated conductors formed of ring sets and tip sets with a maximum of eight colors for the insulations. The same colors are used in both sets with each conductor set having at least three colors to distinguish certain conductors in each set from one another. Insulation colors of the conductors in one of the sets all have a common style. While conductor insulations of each pair are distinguished visually from one another, each conductor of a certain color and style forms a pair with a conductor, which is visually distinguished from further conductors which are paired with all other conductors of that certain color and style.

12 Claims, 6 Drawing Figures

FIG. 1
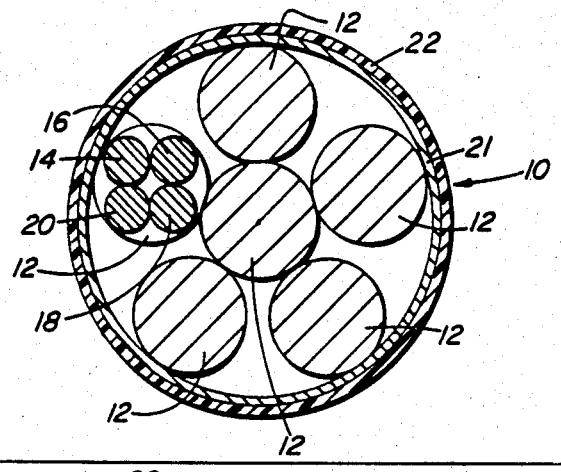
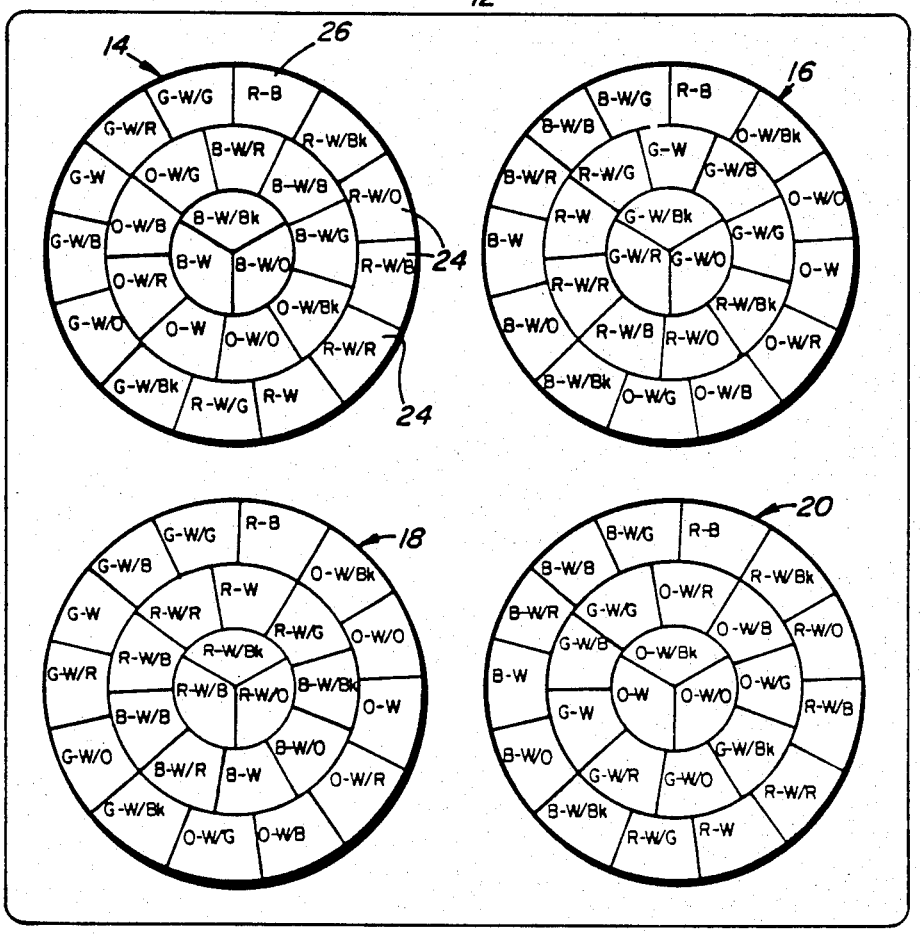
FIG. 2

COLOR CODING IDENTIFICATION OF CONDUCTORS IN TELECOMMUNICATIONS CABLE

This invention relates to color coding identification of pulp or paper insulated conductors in binder units for telecommunications cable.

Binder units, each incorporating twenty-five pairs of conductors, are conventional structures at the present time because twenty-five pairs is a convenient number for modular splicing systems. It is important that this predetermined number of pairs is identifiable throughout a cable run for purposes of plant administration or restoration purposes.

The conventional practice for splicing pulp insulated conductor pairs is to splice each pair in a binder unit to any other pair in a corresponding unit of an adjacent length of cable. This procedure minimizes splicing labour time and provides an improvement in reducing crosstalk. Consequently, in conventional practice, it has not been considered necessary, as an essential requirement, to provide for the clear identification of each individual pair of conductors from others in a binder unit and thus in a cable.

Problems may arise in conductor pair identification after cable has been placed in use. Repairs to or restoration of installed cable need to be made it is accidentally cut into or damaged. Restoration of communication service requires the joining together of matching severed ends of conductors. Unless conductor pairs are clearly identifiable from others without relying on their position within a binder unit, then joining severed ends may be extremely difficult without time and labour isage to eliminate errors during splicing, especially when binder units are normally made of at least twenty-five pairs.

In an effort to provide a cable structure in which individual pairs of conductors are identifiable in twenty-five pair binder units, U.S. Pat. No. 4,128,736, entitled "Cable Design with Limited Colour Coding" and granted to W. G. Nutt and M. E. Roach on Dec. 5, 1978, discloses a colour coding system for pulp insulated cable. Twisted conductor pairs are identified by the colors of the conductors and by the positions of the pairs in the unit. Unfortunately, this system involves the use of identical color combinations of conductors in some of the pairs and should any of the pairs become displaced, then confusion of pairs and conductors may result.

In U.S. Pat. No. 4,158,746, titled "Cable with Colour Coding Identification of Groups" and granted on June 19, 1979 to D. W. Taylor and J. P. Waucheul, there is dexcribed a color coding system which identifies all of the conductor pairs of a particular binder unit or group (e.g. of twenty-five pairs) and with regard to relative pair location within the binder unit. While a minimal number of colors, i.e. five is required for this purpose, each conductor pair is not positively identified from every other pair in each binder unit by color. In practice, it has been found that this method of identification is not reliable and is time consuming.

Neither of the cables disclosed in the above patents has conductors which are readily identifiable after damage or cutting into a cable after installation.

It should be made clear that positive identification of plastics insulated conductor pairs has been achieved in a twenty-five pair binder unit, but this has involved the use of ten different colors. This cable has been described in Canadian Pat. No. 655,934 entitled "Colour Coded Cable" and granted to Western Electric company on Jan. 15, 1963.

The use of ten different colors, however, is not practical for positively identifying pulp or paper insulated conductor pairs in a twenty-five pair binder unit. Coloring of pulp insulation involves the use of color dies. It is impossible consistently to control the color concentrations and resolutions of these dies, to maintain uniformity of die application and to dry the dyed pulp in a consistent manner. As a result, color tones are not controllable and, because of this, some colored pulp insulations are dificult to distinguish from others. Colors which may be confused include violet with blue and black with slate. The possibility of confusion is increased after periods of use of cable, because the colors tend to fade. Consideration of the range of colors shows that the use of ten different colors for pulp color identification must involve at least two colors which may be confused.

The present invention provides a binder unit of twenty-five pairs of pulp insulated conductors in which, with the use of fewer colors, each pair is positively identified from all others within the unit without any reliance placed upon positioning of pairs within the unit. The invention also provides a cable comprising a plurality of binder units in each of which the conductor pairs are identifiable from all others in the unit and in which the binder units are clearly distinguished from the other or others.

According to one aspect of the present invention, a binder unit is provided of twenty-five pulp or paper insulated ring conductors forming a first conductor set and twenty-five pulp insulated tip conductors forming a second conductor set and in which:

(a) each ring conductor forms a twisted pair with a tip conductor thus providing twenty-five pairs;

(b) the conductor insulations have colors, a maximum of eight colors being present in the twenty-five pairs with the same colors used in both sets with each set having at least three colors and with colors distinguishing certain of the conductors in each set from one another;

(c) the insulation colors of the conductors in one of the sets all have a common style; and (d) with the conductors of each pair visually distinguished from one another, each of the conductors of one color and style forms a pair with a conductor which is visually distinguished from a further conductor which forms a pair with any other conductor of said one color or style.

In a preferred aspect of the invention, a binder unit has one of its conductor sets divided into four first groups, the groups having four insulation colors in the common style, one colour to each group, and three of the first groups each has six conductors and the fourth of the first groups has seven conductors. The other set has twenty-four conductors forming six second groups with four conductors in each group. Groups one to four of the second groups have four insulation colors which are the same as in the first groups, but represented in a different style from in the first groups. A fifth and sixth of the second groups each has an insulation color or style different from other second groups. The twenty-fifth conductor of the other set has an insulation color which is either different from or is represented in a different style from the insulation colors in the groups of the other set. This color is also different from or in a different style from the insulation color of the fourth of the first groups. In this arrangement which requires a maximum of seven colors, the twenty-fifth conductor forms a pair with a conductor of the fourth of the first groups.

However, if either of the fifth or sixth of the second groups has no insulation color added and the twenty-fifth conductor has the same insulation color and style as one of the first groups of six conductors, then each pair of conductors is identifiable with six colors, that is five added colors only.

In the preferred aspect of the invention, it is thus made possible for each individual pair of conductors to be color identified positively from others while using as few colors as possible, i.e. no additional colors than are used in conventional practice to identify conductor pairs less accurately and less positively. Four colors are used for one set of conductors (ring or tip) and six colors for the other set. The ring conductors may have the four colors with each conductor having one colour only so that each of three colors is applied to six conductors and the fourth color is applied to seven. All of the conductors of one set, e.g. ring conductors, may be colored in the same style, e.g. a solid overall colour, stripes, or dash coloration etc., to identify all of these conductors as ring conductors. In this case, the tip conductors will need to be colored in a style or styles which is different from the chosen style for the ring conductors, or, if it is necessary to have a tip conductor in the same style as a ring conductor, then the combination of that particular pair coloration will indicate which is the ring conductor and which is the tip conductor. For instance, tip conductors may be distinguished from one another in six groups, the conductors in each group having a differently colored insulation from all other groups. Each of five of these groups consists of four conductors with a single color applied. The sixth group has no color applied and is hence distinguished by natural surface color from the colored groups. It follows that there are twenty-four tip conductors falling into these groups with the colored conductors (twenty) having different color style from the ring conductors, e.g. dash colors when the ring conductors have solid overall colors. The four uncolored tip conductors are identifiable also from the colors of the ring conductors. The twenty-fifth tip conductor may then be colored with the same color and style (e.g. overall solid color) as one of the ring conductor groups.

When using the color combination as shown above, great reliance may be placed upon identifying certain of the conductors by the lack of applied color and also by the avoidance of using an additional color by using, for the conductor of one of the tip or ring sets, the same color and style as conductors in the other set.

Of course, the tip conductor set instead of the ring conductor set may be identified by a single color style, e.g. the solid overall color, in which case the ring conductors will need to be identified, some by color, others by lack of color as provided by certain groups, and by a single conductor of a style and possibly color used by a group of tip conductors.

In another aspect of the invention, the conductors are arranged in groups of five in each set. At least four of the groups have the same colors as groups in the other set but represented in a different style. All the groups in one set may have the same colors but different styles from those of the other set. However, one of the sets may have only four added colors and one of the groups in that set has a natural insulation color.

In yet a further aspect of the invention, one of the sets is arranged in three groups of conductos, two groups having eight conductors and the third of the first group, nine conductors. In this case, the other set has eight second groups with three conductors in each group; and three of the second groups have the same color but different style from the first groups. A twenty-fifth conductor of the other set has either its color or style distinguished from the other insulation of colours of that set. This conductor is formed into a pair with one of the conductors of the third of the first groups from which it is also distinguished.

Embodiments of the invention will now be described by way of example, with reference to the accompanying drawings in which:

FIG. 1 is a diagrammatic cross-sectional view through a hundred pair conductor cable;

FIG. 2 is a diagrammatic cross-sectional exploded view, on larger scale, of four binder units in the cable;

Figure 3:
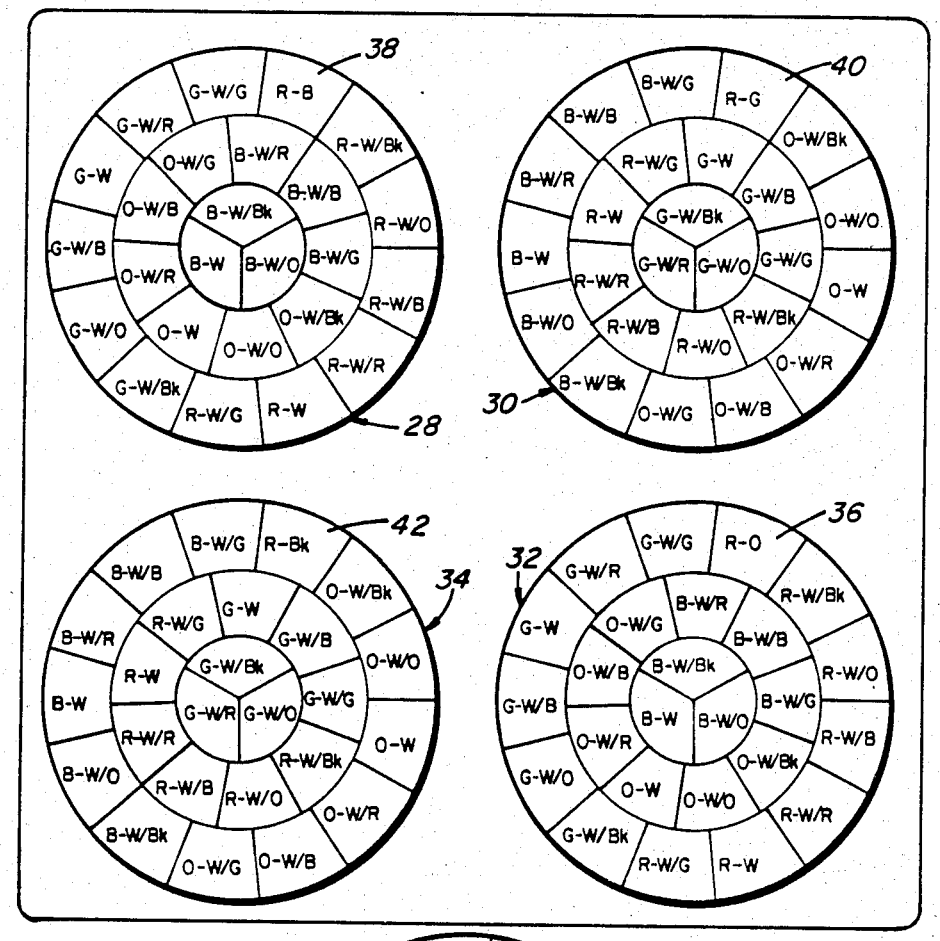
FIG. 3 is a view similar to FIG. 2 of a modification of the first embodiment.

In a first embodiment as shown by FIG. 1, a telecommunications cable 10 has a core comprising 600 pairs of twisted together pulp or paper insulated conductors. This is formed by six, multi units 12 of 100 pairs each. Each multi unit incorporates four binder units 14, 16, 18 and 20, each of twenty-five pairs as shown by one of the units 12 in FIG. 1. A conventional shield or sheath 21 and jacket 22 surrounds the core. Each binder unit is formed by stranding together of its pairs and has a binding tape (not shown) to separate it from the other binder units. Four units are in turn stranded together to provide a multi unit.

In FIG. 2, each unit 14, 16, 18 and 20 is shown separated away from the others for ease of description. As will be seen, the four units are similarly constructed while having color differences or predominance which distinguishes each unit from the others. Each binder unit is constructed according to the same design as all the others and while using a maximum of five added colors, each twisted pair is distinguishable from all of the others in its unit and the ring conductor and tip conductor are identifiable in each case. Initially therefore, to show the method of distinguishing conductors and pairs of each unit, one unit only, i.e. unit 14, will be described.

As shown by FIG. 2, unit 14 has its conductor pairs 24 arranged as a nucleus of three pairs, the nucleus surrounded by an inner layer of nine pairs and an outer layer of thirteen pairs.

The twenty-five ring conductors have their insulation surface coloured in an overall single insulation color which distinguishes them as ring conductors. Four colors are used for this, namely green, red, blue and orange and each of these colors is shown by its initial letter "G"' "R", "B" or "O", being the first letter in each of the substantially trapezoidal shapes representing the pairs 24 in unit 14. Hence, as is seen from FIG. 2, the ring conductors are in four groups, each of different overall color. In three groups, colored green, orange and blue, there are six ring conductors in each group. In the fourth or red group, there are seven ring conductors.

The twenty-five tip conductors are reprsented, in the main, in different style to avoid confusion with the ring conductors. Twenty-four of the tip conductors are in six color groups, each having four conductors. In these six groups, five added colors only are used, these colors being black, orange, green, blue and red. In the other group, no added color is used and the surface color of the insulation of each conductor is natural white or off-white. Of the five colored groups, the color style is performed by dash stains along the insulation surface with the appropriate color. Thus, in the five colored groups, each conductor shows two colors, one its natural white or off-white and the other, one of the five chosen colors. In FIG. 2, the letters following the dash (-) in each trapezoid indicates the dash color of the tip conductor. The colors are represented as follows:

TABLE I

| Color | Code |
|---|---|
| Natural White | W |
| Green Dash | W/G |
| Red Dash | W/R |
| Blue Dash | W/B |
| Orange Dash | W/O |
| Black Dash | W/Bk |

Hence, using the five added colors and natural color in one group, twenty-four of the tip conductors are colored and are distinguished from the solid all over colors of the ring conductor insulations. The remaining or twenty-fifth tip conductor is given an overall single insulation color. While this may appear to cause confusion if it is the same color as one of the groups of ring conductors, confusion is nevertheless avoided if the chosen overall color is different from that of the group of ring conductors having seven in the group and is formed into a pair with a conductor of that group. In this embodiment, that particular ring conductor group is red. Thus, the remaining tip conductor may be of any other of the overall colors and, in this case, is blue as is shown by the 'B' following the dash (-) in trapezoid 26.

As shown by FIG. 2, in unit 14, the tip conductors in each of the six groups are formed into pairs, with the ring conductors. Each tip conductor in each group (i.e. four conductors), is twisted with a differently colored ring conductor so that the final combination of the two conductors produces a different color result from the others. Hence, for the "W/G" tip conductors in unit 14, one of each of the four conductors is twisted with a "G", "R", "O" or "B" ring conductor.

Care is taken to ensure that one of the red ("R") ring conductor is twisted with the blue solid coloured tip conductor.

As may be seen, therefore, with the use of six colors (i.e. five added colors) only, the twenty-five twisted pairs may be individually located in positive fashion and without chance of confusing them with others in the binder unit even though the pairs may be found removed from a desired and predetermined position in the unit.

Nevertheless, the binder unit 14 is stranded in predetermined manner. As shown, the three pairs in the nucleus have ring conductors of one color, i.e. blue and the inner layer has six pairs with orange ring conductors and three pairs with blue ring conductors. A predominance of solid green and solid red is provided in the outer layer by having pairs with six green ring conductors and seven with red ring conductors.

The other three units 16, 18 and 20 are composed of pairs of conductors each of which are of the exact color combinations of one of the pairs in each other unit. However, the arrangements of the pairs in these other units are different from each other and from unit 14 to ensure that a different color predominance shows in the outer layer of each unit. Thus in unit 16, six outer layer pairs have ring conductors in solid blue while six others are in orange. In unit 18, twelve of the outer layer pairs are divided equally between green and orange and in unit 20, the pairs are equally divided between blue and red. In each of the units 16, 18, 20 as with unit 14, the red ring conductor-blue solid colour tip conductor pair is also in the outer layer.

It is clear, therefore, that not only is each pair individually identifiable in each binder unit, but each binder unit is easily identifiable from the other binder units because of its predominant outer colours. There need be no reliance placed, therefore, on the color of the binder to identify a binder unit.

Thus, in the event of repairs being needed after installation of the above cable, the ends of conductors of broken pairs are easily identifiable for splicing purposes thus eliminating the use of test procedures to discover any errors in splicing.

In a modification of the first embodiment (not shown), the twenty-fifth tip conductor insulation is not in an overall color which is the same as one of the ring conductor groups but is, instead, of the same style as the other tip conductors. For avoidance of confusion with other tip conductors, the twenty-fifth conductor insulation has a different color applied, for instance brown. In this case, the insulation is its natural off-white colour with dash stains of brown.

In another modification of the first embodiment as shown by FIG. 3, a multi unit is formed of four binder units 28, 30, 32 and 34 of the same basic construction as the units in the embodiment. Unit 28 is identical in colors and color combinations to unit 14 of the first embodiment. The diagonally opposite binder unit 32 is exactly the same as unit 28 in color combination, except for the outer layer pair 36 which has its ring and tip conductor insulations in overall colors. As will be seen, this pair has an overall orange tip conductor insulation with the red ring conductor insulation, whereas pair 38 of unit 28 has an overall blue tip conductor insulation. Also unit 30 is of the same color combination as unit 16 in the embodiment, except that in its outside layer pair 40, the tip conductor is overall green. In the diagonally opposite unit 34, the colors are also combined in the same way as for unit 16 except that the tip conductor of the corresponding outer layer pair 42 is an overall black.

As shown by this modification, if diagonally opposite binder units are similar in color combination in their outer layer, except for one outer layer pair, then each unit may be identified positively. Alternatively, if any of the binder units are made exactly the same in the outer layer as any other, then different colored binders around the two units will differentiate them.

Figure 4:
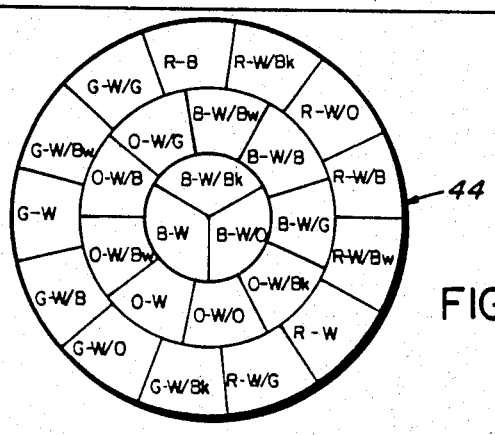
FIG. 4 is a view similar to FIG. 2 of a single binder unit according to a second embodiment.

In a second embodiment as shown by FIG. 4, a binder unit 44 is of twenty-five pair layered construction as described above. Its color combinations are as described in the first embodiment, except that only three of the tip conductor insulation groups have the same colors as the ring conductors, instead of four. Thus, these three groups have the colors green, blue and and orange. The other three groups are black, brown and natural off-white or white. This unit 44 is suitably shown as in FIG. 4 in which one of the tip conductor groups is brown instead of red as in unit 14 of the first embodiment. In FIG. 4 the brown dash stain of these tip conductors is shown by the nomination "Bw". The binder unit of the second embodiment has, of course, seven colors (i.e. six added colors) for complete identification of the pairs and conductors in each pair.

Figure 5:
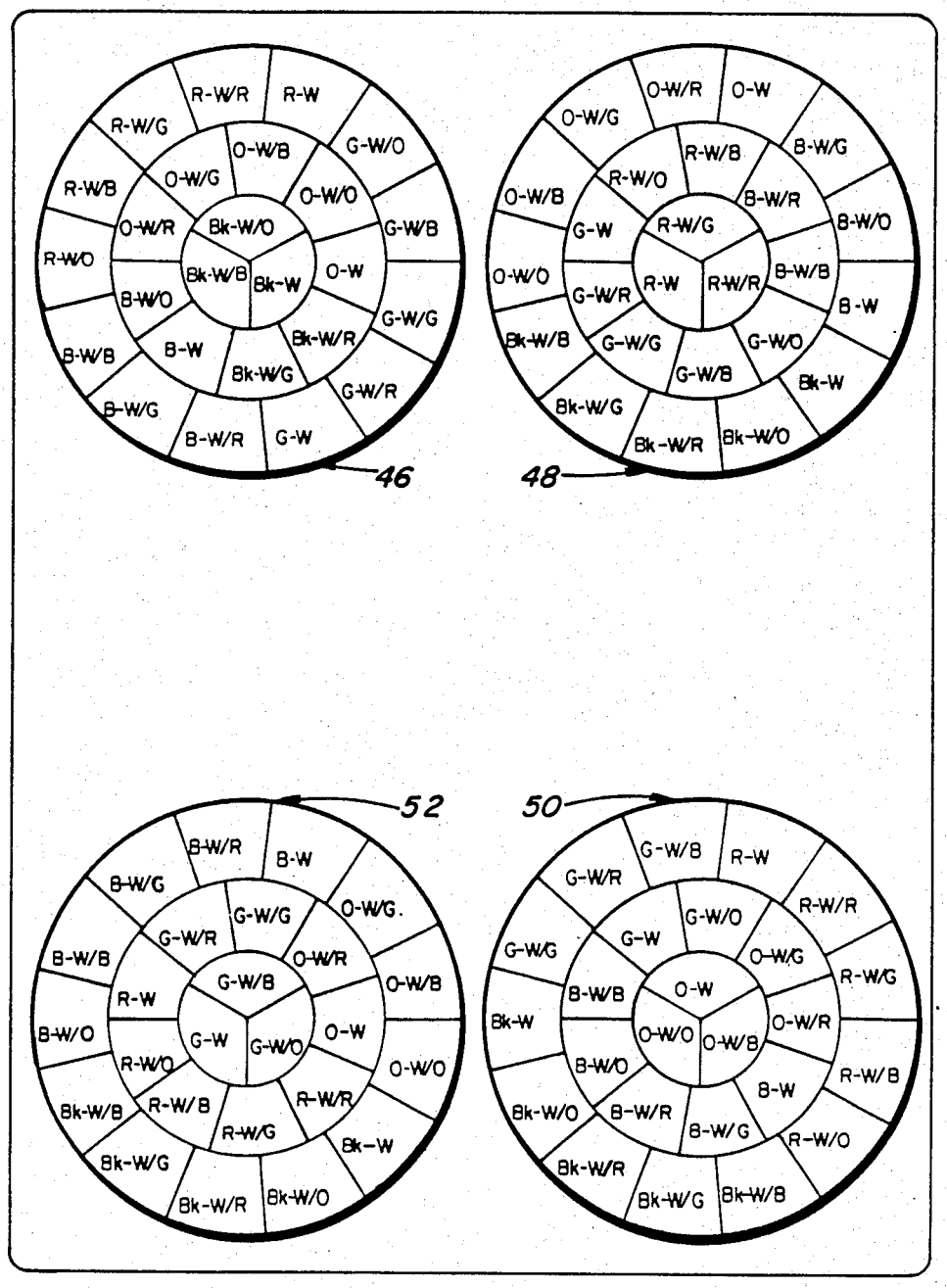
FIG. 5 is a view similar to FIG. 2 of a third embodiment.

In a third embodiment as shown by FIG. 5, the four binder units 46, 48, 50 and 52 (shown diagrammatically) of a multi unit have the same nucleus and inner and outer layer construction of twenty-five pairs as in the first embodiment. However, in this embodiment, the ring conductors are divided into five groups of colors, one color to each group and five conductors in each group. These colors, as applied to the conductor insulations, are in the form of overall colors as in the first embodiment. The colors used are green, red, blue, orange and black, represented respectively, by the initial letters "G", "R", "B" and "O" for the first four colors and by "BK" for black, as the first letter in each trapezoidal shape of each unit 46 to 52.

The tip conductors are also in five groups of colors with five conductors in each. These colors consists of four added colors in four groups, namely, green, red, blue and orange, and the fifth group has no color added so that is in an overall natural white or off-white. The colors which are added are in the form of dash stains. The tip conductor colors are represented in FIG. 4 by the same nomenclature as referred to in the first embodiment for those particular colors.

As may be seen from FIG. 5, in each binder unit, the ring conductors in each group are twisted with tip conductors from all of the tip conductor groups, i.e. each ring conductor to a differently colored tip conductor. As a result, in each binder unit, twenty-five uniquely colored twisted pairs are obtained which are readily identifiable without needing to rely on recognizing their positions in the unit. This is made possible with six colors, i.e., five added colors.

Also as shown by FIG. 5, the binder units themselves may be made identifiable in the core unit by the color predominance of thie ring conductor colors in their outer layers. As shown, binder unit 46 is predominantly red and green and unit 48 is orange and black, while units 50 and 52 are predominantly red and black and black and blue respectively.

In a modification of the third embodiment (not shown), all of the tip conductor groups have dash stain colors which are the same colors as the ring conductor groups. In this case, the naturally colored insulation group is changed to one in which the conductor insulations have black added as a dash stain.

Figure 6:
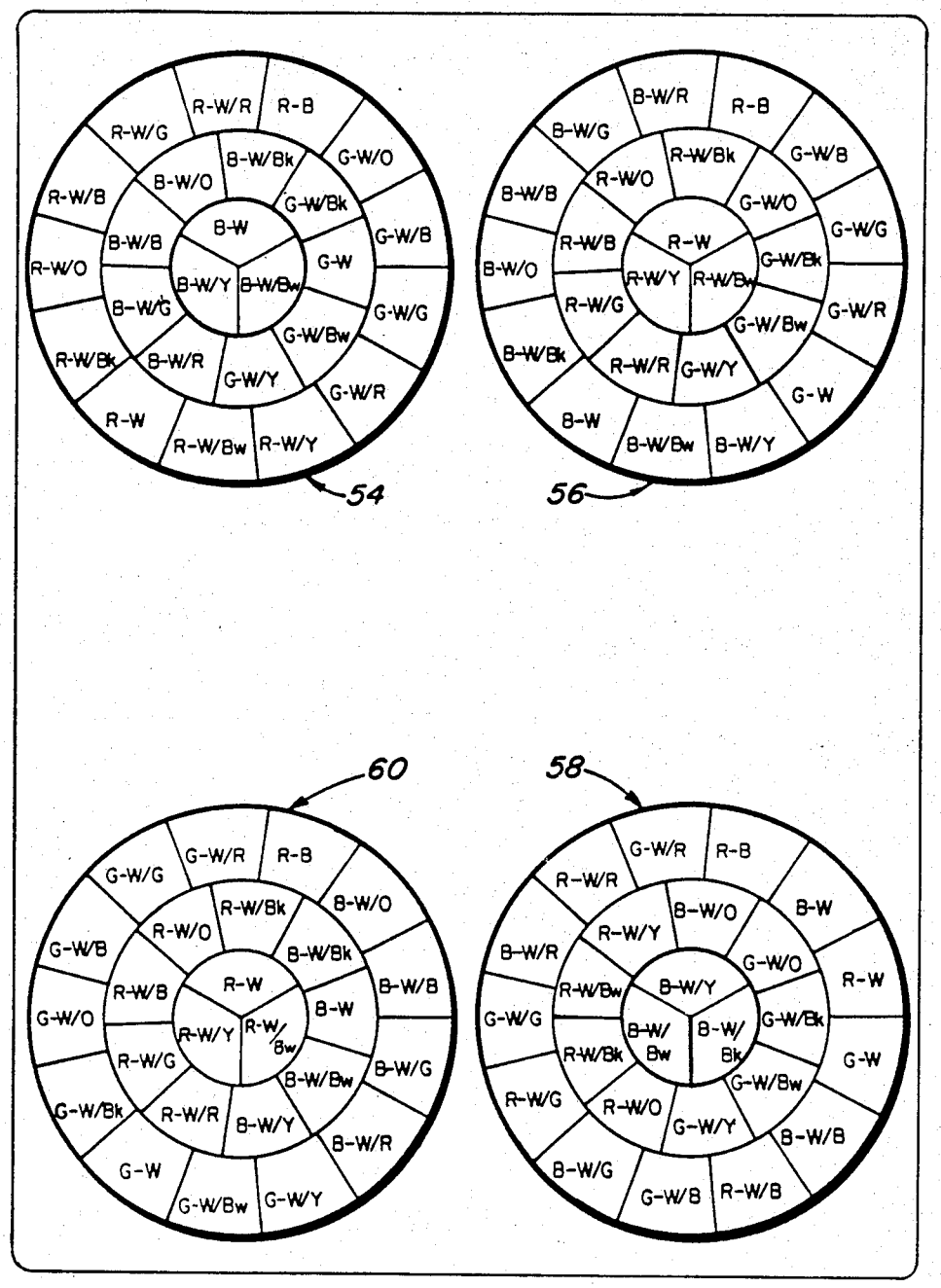
FIG. 6 is a view similar to FIG. 2 of a fourth embodiment.

In a fourth embodiment as shown by FIG. 6, in each of four binder units 54, 56, 58 and 60 of a core unit, the twenty-five ring conductors are divided into three groups of conductors with three different insulation colors, one color to each group. These colors are, for instance red, green and blue, designated in the same manner as in previous embodiments. Two of the groups, e.g. the blue and green groups, have eight conductors each and the third or red group has nine conductors.

Twenty-four of the tip conductors are divided into eight groups of three conductors. Three of these eight groups have dash colors on their insulations which are the same colors as the ring conductor groups. The other five groups each has a different color, e.g. dash stains of orange, black, yellow and brown and an overall natural colour. The twenty-fifth conductor has an overall insulation color which may be the same color in a different style from the other tip conductors, or in a different color. For convenience, the twenty-fifth tip conductor is in an overall blue, which is the same as one of the ring conductor groups.

As shown, for instance by binder unit 54, the ring conductors of each group are twisted with tip conductors from all the tip conductor groups, i.e. each ring conductor to a differently colored tip conductor. Thus, one ring conductor, colored red, remains. This is twisted with the overall blue tip conductor.

Hence, with the procedure of colors followed by the fourth embodiment, eight colours, i.e., seven added color are used.

In the multi unit, the binder units have certain color predominance in their outer layers to distinguish them easily in the multi unit. In the units 54, 56 and 60, the color predominance is red, blue and green, respectively. In unit 58, the outer layer has alternating colors of red, green and blue for its ring conductors which gives no particular color predominance, but this lack of dominance makes that unit distinctive.

What is claimed is:

1. A binder unit for telecommunications cable having twenty-five pulp or paper insulated ring conductors forming a first conductor set and twenty-five pulp insulated tip conductors forming a second conductor set and in which:

(a) each ring conductor forms a twisted pair with a tip conductor thus providing twenty-five pairs;

(b) the conductor insulations have colors, a maximum of eight colors being present in the twenty-five pairs with the same colors used in both sets with each of the conductor sets having at least three colors, and with colors distinguishing certain of the conductors in each set from one another;

(c) the insulation colors of the conductors in one of the sets all having a common style; and (d) with the conductor insulations of each pair visually distinguished from one another, each of the conductors of one common color and common style forms a pair with another conductor which is visually distinguished from conductors which form pairs with all other conductors of said one common insulation color and common style.

2. A binder unit according to claim 1 wherein:

(a) one of the sets comprises twenty-five conductors in four first groups, the groups having four insulation colors in the common style, one color to each group, and three of the first groups each has six conductors and the fourth of the first groups has seven conductors;

(b) the other set comprises twenty-four conductors in six second groups with four conductors in each group, groups one to four of the second groups having four insulation colors, which are the same as in the first groups and represented in a different style from in the first groups, one of these colors to each of these four of the second groups, and a fifth and sixth of the second groups each having an insulation color different from other second groups;

(c) the other set also comprising a twenty-fifth conductor which is visually distinguished from the insulation colors in the groups of said other set and also is visually distinguished from the insulation color of said fourth of the first groups; and (d) the pairs comprise conductors from the second groups twisted together with conductors from the four first groups, and said twenty-fifth conductor twisted with a conductor of said fourth of the first groups.

3. A binder unit according to claim 2 wherein either of the fifth and sixth of the second groups has no added insulation color, whereby its insulation color is the natural color of its insulation.

4. A binder unit according to claim 2 wherein the twenty-fifth conductor has the same insulation color and style as one of said three of the first groups, whereby a maximum of six colors is used for the conductor insulations of the unit.

5. A binder unit according to claim 3 wherein the twenty-fifth conductor has the same insulation color and style as one of said three of the first groups, whereby a maximum of five added colors is used for the conductor insulations of the unit.

6. A binder unit according to claim 2 wherein groups one to four of the second groups are represented in a common style which is different from that of said one set.

7. A binder unit according to claim 1 wherein:

(a) one of the sets comprises twenty-five conductors in four first groups, the groups having four insulation colors in the common style, one color to each group, and three of the first groups have six conductors and the fourth of the first groups has seven conductors;

(b) the other set comprises twenty-four conductors in six second groups with four conductors in each group, groups one to three of the second groups having three insulation colors which are the same as three colors in the first groups and represented in a different style from those in the first groups, one of these colors to each of groups one to three of the second groups, and groups four, five and six of the second groups each being visually different from all other second groups;

(c) the other set also comprising a twenty-fifth conductor with an insulation color, which is visually different from the insulation colors in the groups in said other set and also is visually different from the insulation color of the fourth of the first group; and (d) the pairs comprise conductors from the second groups twisted together with conductors from the four first groups, and said twenty-fifth conductor twisted with a conductor of said fourth of the first groups.

8. A binder unit according to claim 1 wherein:

(a) each of the sets comprises twenty-five conductors in five groups, five conductors in each group and in each set, each group is visually different from the others;

(b) at least four of the groups in each set having the same colors as groups in the other set, but represented in a different style from the other set; and (c) the pairs comprise the five conductors of each group of one set twisted together with the conductors of each of the groups of the other set.

9. A binder unit according to claim 8 wherein each of the five groups of each set has the same color as one group in the other set.

10. A binder unit according to claim 8 wherein one group of one set has no added insulation color, whereby its insulation color is the natural color of its insulation.

11. A binder unit according to claim 1 wherein:

(a) one of the sets comprises twenty-five conductors in three first groups, the groups having three insulation colors in the common style, one color to each group, and two of the first groups each has eight conductors and the third of the first groups has nine conductors;

(b) the other set comprises twenty-four conductors in eight second groups with three conductors in each group, three of the second groups having three insulation colors which are the same as in the first group and represented in a different style from in the first group, one color to each of these three of the second groups, and each of the fourth to eighth of the second groups are visually different from all other of the first and second groups;

(c) the other set also comprising a twenty-fifth conductor with an insulation color, which is visually different from the other insulation colors of said other set and is also visually different from the insulation color of said third of the first groups; and (d) the pairs comprise conductors from the second groups twisted together with conductors from the three first groups, and said twenty-fifth conductor twisted with a conductor of said third of the first groups.

12. A binder unit according to claim 1 wherein the pairs are arranged as a nucleus of pairs surrounded by an inner layer of pairs and an outer layer of pairs, the pairs in the outer layer chosen to provide a color domination created by selection of conductors in pairs from common groups.

* * * * *